US010422557B2

(12) United States Patent
Beckett

(10) Patent No.: US 10,422,557 B2
(45) Date of Patent: Sep. 24, 2019

(54) HEAT PUMP AND HEAT ENGINE

(71) Applicant: John Beckett, Famborough (GB)

(72) Inventor: John Beckett, Famborough (GB)

( * ) Notice: Subject to any disclaimer, the term of this patent is extended or adjusted under 35 U.S.C. 154(b) by 0 days.

(21) Appl. No.: 15/773,649

(22) PCT Filed: Nov. 4, 2016

(86) PCT No.: PCT/GB2016/000197
§ 371 (c)(1),
(2) Date: May 4, 2018

(87) PCT Pub. No.: WO2017/077264
PCT Pub. Date: May 11, 2017

(65) Prior Publication Data

US 2018/0320941 A1 Nov. 8, 2018

(30) Foreign Application Priority Data

Nov. 4, 2015 (GB) ..... 1519475.6

(51) Int. Cl.
*F25B 30/02* (2006.01)
*F25B 30/00* (2006.01)
*F02G 1/043* (2006.01)

(52) U.S. Cl.
CPC ..... *F25B 30/02* (2013.01); *F02G 1/043* (2013.01); *F25B 30/00* (2013.01)

(58) Field of Classification Search
CPC ..... F25B 30/02; F25B 30/00; F02G 1/043
(Continued)

(56) References Cited

U.S. PATENT DOCUMENTS 4,470,268 A * 9/1984 Schilling ..... F25B 15/06 62/235.1
5,749,226 A * 5/1998 Bowman ..... F02G 1/0435 257/E23.096

(Continued)

FOREIGN PATENT DOCUMENTS

DE 19742677 A1 4/1999
DE 102004047054 A1 11/2006

OTHER PUBLICATIONS

International Search Report in PCT/GB2016/000197 dated Feb. 10, 2017.

*Primary Examiner* — Hoang M Nguyen
(74) *Attorney, Agent, or Firm* — Manelli Selter PLLC; Edward Stemberger

(57) ABSTRACT

A heat pump, the heat pump having a first end and a second end and further comprising: a working fluid and a chamber to contain said working fluid, the chamber having a first end and a second end corresponding to the first and second ends of the pump, one wall of the chamber acting as a heat exchanger between the chamber and a first heat transfer medium and one wall of the chamber, which may or may not be the same wall as the first mentioned one wall, acting as a heat exchanger between the chamber and a second heat transfer medium. The first heat transfer medium is located at a position between the first end of the pump and an intermediate portion defined at a position between the first and second ends of the heat pump, the first heat transfer medium operationally has a temperature T at the end nearest the intermediate portion, and operationally has a temperature higher than temperature T at the end located nearest the first end of the pump. The second heat transfer medium is located at a position between the intermediate portion and the second end of the pump, and has a temperature T' at the end
(Continued)

nearest the intermediate portion in operation of the heat pump, and a temperature lower than T' at the end nearest the second end of the pump in operation of the heat pump, the second heat transfer medium operationally has a lower average temperature than the first heat transfer medium. The chamber has at least one moveable wall, one said moveable wall being driven by an external energy source and being configured to adjust the volume of the chamber, and one said moveable wall, which may or may not be the same wall as the first mentioned one said movable wall, being arranged to be driven by an external energy source and being capable of adjusting the shape of the chamber while keeping the volume of the chamber constant. The driven movements of the at least one moveable wall producing a repeating cycle including the following phases: a first phase in which the volume of the chamber is decreased; a second phase in which the shape of the chamber can be altered without a change in chamber volume so that a greater volume of the working fluid is at the second end of the chamber than is at the first end of the chamber; a third phase in which the volume of the chamber is increased; and a fourth phase in which the shape of the chamber can be altered without a change in chamber volume so that a greater volume of the working fluid is at the first end of the chamber than is at the second end of the chamber; this cycle causing a net flow of heat into the first heat transfer medium from the working fluid, and causing a net flow of heat from the second heat transfer medium into the working fluid. A heat engine, the heat engine having a first end and a second end and further comprising: a working fluid and a chamber to contain said working fluid, the chamber having a first end and a second end corresponding to the first and second ends of the engine, one wall of the chamber acting as a heat exchanger between the chamber and a first heat transfer medium and one wall of the chamber, which may or may not be the same as the first mentioned one wall, acting as a heat exchanger between the chamber and a second heat transfer medium. The first "neat transfer medium is located at a position between the first end of the engine and an intermediate portion defined at a position located between the first and second ends of the heat engine, the first heat transfer medium has a temperature TA at the end nearest the first end of the engine in operation of the heat engine, and a temperature lower than TA at the end nearest the intermediate portion in operation of the heat engine. The second heat transfer medium is located at a position between the intermediate portion and the second end of the engine, and has a temperature TB at the end nearest the second end of the engine in operation of the heat engine, and a temperature higher than TB at the end nearest the intermediate portion in operation of the heat engine, TB being colder than TA, and the second heat transfer medium operationally having a lower average temperature than the first heat transfer medium. The chamber has at least one moveable wall, one said moveable wall being configured to allow changes in the volume of the chamber, and one said moveable wall, which may or may not be the same wall as the first one said movable wall, being configured to allow adjustment of the shape of the chamber while keeping the volume of the chamber constant. The heat engine is configured to allow a net flow of heat energy from the first heat transfer medium into the working fluid and a net flow of heat energy from the working fluid into the second heat transfer medium to cause variations in the pressure of the working fluid of the chamber, forcing the at least one movable wall to move in a repeating cycle including the following phases: a first phase in which the volume of the chamber is decreased; a second phase in which the shape of the chamber can be altered without a change in chamber volume so that a greater volume of the working fluid is at the first end of the chamber than is at the second end of the chamber; a third phase in which the volume of the chamber is increased; and a fourth phase in which the shape of the chamber can be altered without a change in chamber volume so that a greater volume of the working fluid is at the second end of the chamber than is at the first end of the chamber; the movement cycle being a usable source of mechanical motion during operation of the engine.

20 Claims, 8 Drawing Sheets

(58) Field of Classification Search
USPC ..... 60/516–526; 62/6
See application file for complete search history.

(56) References Cited

U.S. PATENT DOCUMENTS

| | | | | |
|---|---|---|---|---|
| 5,941,079 | A * | 8/1999 | Bowman | F02G 1/0435 257/E23.096 |
| 6,332,323 | B1 | 12/2001 | Reid et al. | |
| 7,832,209 | B2 | 11/2010 | Formosa | |
| 2002/0050342 | A1* | 5/2002 | Gerstmann | F22B 7/00 165/109.1 |
| 2003/0066638 | A1* | 4/2003 | Qu | F24S 10/90 165/186 |
| 2011/0283736 | A1* | 11/2011 | Manabe | F25B 30/04 62/476 |

* cited by examiner

HEAT PUMP AND HEAT ENGINE

This disclosure relates to heat pumps and to heat engines.

External heat engines are well known, and the use of heat pumps in reverse as heat engines is also well known. Practical heat pumps have power outputs lower than their theoretical maximum Coefficient of Performance, as conditions in practical machines are not ideal, and indeed are often far from ideal. The efficiencies of practical heat engines are also lower than their theoretical maximum, and can often be far lower than their theoretical maximum.

The present disclosure has arisen from work by Applicant attempting to provide both a heat pump and a heat engine with good theoretical coefficients of performance. Applicant has also sought to make the actual conditions of operation of practical pumps and of practical engines as close to ideal as possible, as described below.

In accordance with one aspect of this disclosure there is provided a heat pump, the heat pump having a first end and a second end and further comprising: a working fluid and a chamber to contain said working fluid, the chamber having a first end and a second end corresponding to the first and second ends of the pump, one wall of the chamber acting as a heat exchanger between the chamber and a first heat transfer medium and one wall of the chamber, which may or may not be the same wall as the first mentioned one wall, acting as a heat exchanger between the chamber and a second heat transfer medium, the first heat transfer medium being located at a position between the first end of the pump and an intermediate portion defined at a position between the first and second ends of the heat pump, the first heat transfer medium operationally having temperature T at the end nearest the intermediate portion, and operationally having a temperature higher than temperature T at the end located nearest the first end of the pump, the second heat transfer medium being located at a position between the intermediate portion and the second end of the pump, and having a temperature T' at the end nearest the intermediate portion in operation of the heat pump, and a temperature lower than T' at the end nearest the second end of the pump in operation of the heat pump, the second heat transfer medium operationally having a lower average temperature than the first heat transfer medium; the chamber having at least one moveable wall, one said moveable wall being driven by an external energy source and being configured to adjust the volume of the chamber, and one said moveable wall, which may or may not be the same wall as the first mentioned one said movable wall, being arranged to be driven by an external energy source and being capable of adjusting the shape of the chamber while keeping the volume of the chamber constant; the driven movements of the at least one moveable wall being capable of producing a repeating cycle including the following phases:

- a first phase in which the volume of the chamber is decreased;
- a second phase in which the shape of the chamber can be altered without a change in chamber volume so that a greater volume of the working fluid is at the second end of the chamber than is at the first end of the chamber;
- a third phase in which the volume of the chamber is increased; and
- a fourth phase in which the shape of the chamber can be altered without a change in chamber volume so that a greater volume of the working fluid is at the first end of the chamber than is at the second end of the chamber;

this cycle causing a net flow of heat into the first heat transfer medium from the working fluid, and causing a net flow of heat from the second heat transfer medium into the working fluid.

In accordance with a second aspect of this disclosure there is provided a method for pumping heat to a first heat transfer medium from a second heat transfer medium that has a lower average temperature than the first heat transfer medium, the method comprising the steps of:

(a) providing a heat pump having a working fluid and a chamber to contain said working fluid, the pump having a first end and a second end, and the chamber having a first end and a second end corresponding to the first and second ends of the pump; one of the walls of the chamber serving as a heat exchanger both between the chamber and the first heat transfer medium and between the chamber and the second heat transfer medium;

(b) driving at least one wall of the chamber, which is moveable, with an external energy source in a repeating cycle including the following phases:

- a first phase in which the volume of the chamber is decreased;
- a second phase in which the shape of the chamber is altered without a change in chamber volume so that a greater volume of the working fluid is at the second end of the chamber than is at the first end of the chamber;
- a third phase in which the volume of the chamber is increased; and
- a fourth phase in which the shape of the chamber is altered without a change in chamber volume so that a greater volume of the working fluid is at the first end of the chamber than is at the second end of the chamber;

to cause a net flow of heat into the first heat transfer medium from the working fluid, and a net flow of heat from the second heat transfer medium into the working fluid.

The heat pump may have one or more of the following features: the first heat transfer medium comprises a transfer fluid and a channel to contain said transfer fluid. The transfer fluid operationally enters the channel at a temperature T through an entry port, the entry port being located at or near the intermediate portion, and operationally exits the channel at a temperature higher than temperature T through an exit port, the exit port being located at or near the first end of the pump. The second heat transfer medium comprises a transfer fluid and a channel to contain said transfer fluid, the transfer fluid enters the channel through an entry port at a temperature T' in operation of the heat pump, the entry port being located at or near the intermediate portion, the transfer fluid exits the channel through an exit port, the exit port being located at or near the second end of the pump. There is only one fluid entry port, that port being located at the intermediate portion, through which the transfer fluid enters at temperature T=T' in operation of the pump, the fluid then splitting to pass through the respective channels of the heat transfer mediums. The heat transfer mediums are positioned so that in operation there is only heat flow from the working fluid to the transfer fluid between the intermediate portion and the exit port of the first heat transfer medium, and there is only heat flow from the transfer fluid to the working fluid between the intermediate portion and the exit port of the second heat transfer medium. There is only one moveable chamber wall, the movement of that wall causing both the volume changes in the chamber and the shape changes in the chamber. The moveable wall of the chamber is driven by a single actuator in contact with the moveable wall. The actuator is an electromagnetic actuator. The actuator has a short stroke. The actuator interacts directly with the plates.

The single actuator is offset from the centre of the wall so that the section of the moveable wall furthest from the actuator will lag behind the section of wall closest to the actuator. The moveable wall is heavier at one end than at the other end in order that the heavier end of the moveable wall will lag behind the lighter end of the movable wall. There is a biasing means to restrain the lag of the heavier end of the movable wall. Energy stored in the biasing means is used to move the working fluid. The moveable wall of the chamber is driven by two actuators, optionally with a phase difference between the two actuators.

In accordance with a third and alternative aspect of this disclosure there is provided a heat engine, the heat engine having a first end and a second end and further comprising: a working fluid and a chamber to contain said working fluid, the chamber having a first end and a second end corresponding to the first and second ends of the engine, one wall of the chamber acting as a heat exchanger between the chamber and a first heat transfer medium and one wall of the chamber, which may or may not be the same as the first mentioned one wall, acting as a heat exchanger between the chamber and a second heat transfer medium, the first heat transfer medium being located at a position between the first end of the engine and an intermediate portion defined at a position located between the first and second ends of the heat engine, the first heat transfer medium having a temperature $T_A$ at the end nearest the first end of the engine in operation of the heat engine, and a temperature lower than $T_A$ at the end nearest the intermediate portion in operation of the heat engine, the second heat transfer medium being located at a position between the intermediate portion and the second end of the engine, and having a temperature $T_B$ at the end nearest the second end of the engine in operation of the heat engine, and a temperature higher than $T_B$ at the end nearest the intermediate portion in operation of the heat engine, $T_B$ being colder than $T_A$, and the second heat transfer medium operationally having a lower average temperature than the first heat transfer medium; the chamber having at least one moveable wall, one said moveable wall being configured to allow changes in the volume of the chamber, and one said moveable wall, which may or may not be the same wall as the first one said movable wall, being configured to allow adjustment of the shape of the chamber while keeping the volume of the chamber constant; the heat engine being configured to allow a net flow of heat energy from the first heat transfer medium into the working fluid and a net flow of heat energy from the working fluid into the second heat transfer medium to cause variations in the pressure of the working fluid of the chamber, forcing the at least one movable wall to move in a repeating cycle including the following phases:

- a first phase in which the volume of the chamber is decreased;
- a second phase in which the shape of the chamber can be altered without a change in chamber volume so that a greater volume of the working fluid is at the first end of the chamber than is at the second end of the chamber;
- a third phase in which the volume of the chamber is increased; and
- a fourth phase in which the shape of the chamber can be altered without a change in chamber volume so that a greater volume of the working fluid is at the second end of the chamber than is at the first end of the chamber;

the movement cycle being a usable source of mechanical motion during operation of the engine.

In accordance with a fourth and alternative aspect of this disclosure there is provided a method for obtaining useful mechanical motion from the flow of heat energy from a first heat transfer medium via a working fluid to a second heat transfer medium, the second heat transfer medium having a lower average temperature than the first heat transfer medium, the method comprising the steps of:

(a) providing a heat engine having a chamber to contain said working fluid, the engine having a first end and a second end, and the chamber having a first end and a second end corresponding to the first and second ends of the engine; one of the walls of the chamber serving as a heat exchanger both between the chamber and the first heat transfer medium and between the chamber and the second heat transfer medium;

(b) causing at least one wall of the chamber, which is moveable, to move as a result of the changes in pressure of the working fluid in a repeating cycle including the following phases:

- a first phase in which the volume of the chamber is decreased;
- a second phase in which the shape of the chamber can be altered without a change in chamber volume so that a greater volume of the working fluid is at the first end of the chamber than is at the second end of the chamber;
- a third phase in which the volume of the chamber is increased; and
- a fourth phase in which the shape of the chamber can be altered without a change in chamber volume so that a greater volume of the working fluid is at the second end of the chamber than is at the first end of the chamber;

the movement cycle providing said useful source of mechanical motion.

The heat engine may have one or more of the following features: the first heat transfer medium comprises a transfer fluid and a channel to contain said transfer fluid. The transfer fluid enters the channel through an entry port at a temperature $T_A$ in operation of the heat engine, the entry port being located at or near the first end of the engine, and operationally exits the channel at a temperature lower than temperature $T_A$ through an exit port, the exit port being located at or near the intermediate portion. The second heat transfer medium comprises a transfer fluid and a channel to contain said transfer fluid, the transfer fluid operationally enters the channel at a temperature $T_B$ through an entry port, the entry port being located at or near the second end of the engine, and operationally exits the channel at a temperature higher than temperature $T_B$ through an exit port, the exit port being located at or near the intermediate portion. There is only one fluid exit port, that port being located at the intermediate portion, through which the transfer fluids from the first and second heat transfer mediums operationally exit the engine. The exit port or ports are positioned so that in operation there is only heat flow from the transfer fluid to the working fluid between the first entry port and the intermediate portion and there is only heat flow from the working fluid to the transfer fluid between the second entry port and the intermediate portion. There is only one moveable chamber wall, the movement of that wall being caused by the changes in pressure in the working fluid and resulting in both the volume changes in the chamber and the shape changes in the chamber. The moveable wall of the chamber drives a single driven member. The single driven member is offset from the centre of the wall so that the section of the moveable wall furthest from the driven member will lag behind the section of wall closest to the driven member while the wall drives the driven member. The single driven member is shaped to aid the movement cycle. The moveable wall is heavier at one end than at the other end in order that the heavier end of the moveable wall will lag behind the lighter end of the movable wall while driving the driven member. The moveable wall of the chamber drives two driven members, optionally with a phase difference between the two driven members.

The heat pump and/or the heat engine may have one or more of the following features: the chamber has a distance between the wall acting as a heat exchanger and a chamber wall opposed to it, that is small in comparison to the length from the first end to the second end of the chamber. The moveable wall of the chamber is generally opposed to the wall acting as a heat exchanger. The movable wall is made from a heat insulator. The wall acting as a heat exchanger is made of metal. The wall acting as a heat exchanger is made of ceramic. The wall acting as a heat exchanger is made of plastics. The wall acting as a heat exchanger is made of quartz. The wall acting as a heat exchanger has a plurality of fine channels that transfer fluid may flow through. The wall acting as a heat exchanger is shaped or textured to alter the flow of the working fluid through the chamber. The wall opposed to the wall acting as a heat exchanger is shaped or textured to alter the flow of the working fluid through the chamber. The texturing or shaping of the wall acting as a heat exchanger may cause the working fluid to flow in a helical path from one end of the chamber to the other end of the chamber. The texturing or shaping of the wall opposed to the wall acting as a heat exchanger may cause the working fluid to flow in a helical path from one end of the chamber to the other end of the chamber. The texturing or shaping of the wall acting as a heat exchanger may cause the working fluid to flow in a plurality of helical rods from one end of the chamber to the other end of the chamber. The texturing or shaping of the wall opposed to the wall acting as a heat exchanger may cause the working fluid to flow in a plurality of helical rods from one end of the chamber to the other end of the chamber. The texturing or shaping of the wall acting as a heat exchanger may cause the working fluid to flow in a plurality of helical rods from one end of the chamber to the other end of the chamber, the direction of rotation of each fluid rod being opposite to the direction of the neighbouring fluid rods. The texturing or shaping of the wall opposed to the wall acting as a heat exchanger may cause the working fluid to flow in a plurality of helical rods from one end of the chamber to the other end of the chamber, the direction of rotation of each fluid rod being opposite to the direction of the neighbouring fluid rods.

Sealing means for the periphery of the or each moveable wall of the chamber includes a band of pliable material. The sealing means for the or each moveable wall of the chamber is a band of thermally conductive material. The sealing means for the or each moveable wall of the chamber comprises metal. The sealing means for the or each moveable wall of the chamber comprises corrugated metal. The sealing means for the or each moveable wall of the chamber includes seal-stops, the seal stops optionally being thermally conductive. The sealing means for the or each moveable wall of the chamber includes a corrugated metal section and a pliable or elastic section, the metal section of the seal being in contact with the seal-stops. The sealing means is positioned in a recess filled with the working fluid, the recess being set slightly apart from the majority of the working fluid. The recess is shaped to keep the ratio between the working chamber and the recess as near constant as possible, in order to reduce the flow of fluid between the working chamber and the recess.

Two pumps as described above may be arranged together in order that a single actuator may drive the movable walls of the working chambers of each respective pump simultaneously. Two pumps as described above may be arranged together in order that two actuators, with a phase difference between the two actuators, may drive the movable walls of the working chambers of each respective pump simultaneously. Two engines as described above may be arranged together in order that a single driven member may be driven by the movable walls of the working chambers of each respective engine simultaneously. Two engines as described above may be arranged together in order that two driven members, with a phase difference between the two driven members, may be driven by the movable walls of the working chambers of each respective engine simultaneously. A pump and an engine as defined above may be used in combination as a heating system. A pump as above may be used in conjunction with a conventional heat exchanger as a heating system. A pump and an engine as defined above may be connected in such a way that the oxidation of a mixture of flammable gas provides a useful source of energy that may be used in the running of the pump/engine system. A pump and an engine may be arranged so that the second heat transfer medium of the pump comprises the working fluid of the engine between the intermediate portion and the second end of the engine, and so that the second heat transfer medium for the engine comprises the working fluid of the pump between the intermediate portion and the second end of the pump. A pump and an engine may be arranged so that the first heat transfer medium of the pump comprises the working fluid of the engine between the intermediate portion and the first end of the engine, and so that the first heat transfer medium for the engine comprises the working fluid of the pump between the intermediate portion and the first end of the pump. Where a pump and an engine are arranged so that the second heat transfer medium of the pump comprises the working fluid of the engine between the intermediate portion and the second end of the engine, and so that the second heat transfer medium for the engine comprises the working fluid of the pump between the intermediate portion and the second end of the pump, the working fluids are thermally connected between the intermediate portion and the second end of the apparatus via channels, the channels having an inner core comprising a good thermal conductor, and an outer casing comprising a good thermal insulator. Where a pump and an engine are arranged so that the first heat transfer medium of the pump comprises the working fluid of the engine between the intermediate portion and the first end of the engine, and so that the first heat transfer medium for the engine comprises the working fluid of the pump between the intermediate portion and the first end of the pump, the working fluids are thermally connected between the intermediate portion and the first end of the apparatus via channels, the channels having an inner core comprising a good thermal conductor, and an outer casing comprising a good thermal insulator.

Reference may now be made to the description of preferred embodiments by way of example only with reference to the accompanying drawings, in which.

Figure 1:
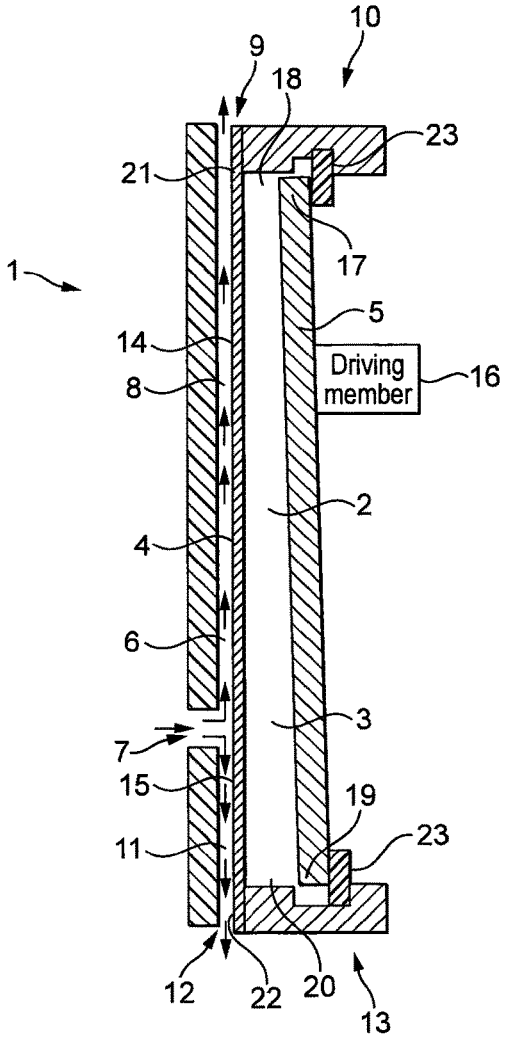
FIG. 1 is a sectional view through a heat pump.

Referring first to FIG. 1, heat pump 1 includes a working fluid 2 within chamber 3. One wall of the chamber is a heat exchanger 4, and the wall opposed to heat exchanger 4 is a moveable wall 5. Wall 5 may be driven by an external energy source.

The heat pump also includes a transfer fluid 6 that enters pump 1 through entry port 7 at temperature T. Transfer fluid 6 splits, a first portion 8 flowing from entry port 7 through a channel to a first exit port 9 at a first end 10 of pump 1, the first heat transfer medium comprising first fluid portion 8 and the associated channel in this embodiment, and a second portion 11 of transfer fluid 6 flowing from entry port 7 through a channel to a second exit port 12, located at a second end 13 of pump 1, the second heat transfer medium comprising second fluid portion 11 and the associated channel in this embodiment. The intermediate portion does not need to comprise any physical apparatus, it merely serves to define the boundary between two sections of the pump (or, in other embodiments, of the engine). In the Embodiment of FIG. 1, the intermediate portion is generally planar, passes through port 7, and is perpendicular to the axis from the first end 10 to the second end 13 of the pump. The heat exchanger wall 4 can be considered to have two sections, a first section 14 in contact with the first portion 8 of the transfer fluid, and a second section 15 in contact with the second portion 11 of the transfer fluid.

Heat exchanger wall 4 is thin, so that there is good heat transfer across the wall, and relatively poor heat transfer along the length of the wall. Heat exchanger wall 4 may be made from any suitably thermally conductive material, such materials including (but not limited to) metal, ceramic, plastics or quartz. Heat exchanger wall 4 may have a plurality of fine channels through which transfer fluid 6 may flow.

The driven movements of wall 5 cause a net transfer of heat energy from the working fluid 2 across heat exchanger 4 into the first portion 8 of transfer fluid 6, increasing the temperature of the first portion 8 of transfer fluid. The driven movements of wall 5 also cause a net transfer of heat energy from the second portion 11 of transfer fluid across the heat exchanger 4 into the working fluid 2, causing a decrease in the temperature of second portion 11 of the transfer fluid.

The movable wall 5 will be driven by an external drive means, in this case an actuator, (driving member 16). The driving member will cause the following repeating cycle of movements:

- A first phase in which movable wall 5 is moved towards heat exchanger wall 4 in a direction perpendicular to wall 4, while the angle between wall 4 and wall 5 is constant.
- A second phase in which the angle between wall 4 and wall 5 is altered, while there is no net movement of wall 5 in relation to wall 4. The angle alteration causes a first end 17 of wall 5 to move towards heat exchanger wall 4, decreasing the distance between end 17 and wall 4 at the first end of the chamber 18, while a second end 19 of wall 5 is moved away from heat exchanger wall 4, increasing the distance between end 19 and wall L at a second of the chamber 20, resulting in a net flow of working fluid from the first end 18 of the chamber to the second end 20 of the chamber.
- A third phase in which movable wall 5 is moved away from heat exchanger wall 4 in a direction perpendicular to wall 4, while the angle between wall 4 and wall 5 is constant.
- A fourth phase in which the angle between wall 4 and wall 5 is altered, while there is no net movement of wall 5 in relation to wall 4. The angle alteration causes the first end 17 of wall 5 to move away from heat exchanger wall 4, increasing the distance between end 17 and wall 4 at the first end of the chamber 18, while a second end 19 of wall 5 is moved towards heat exchanger wall 4, decreasing the distance between end 19 and wall 4 at a second of the chamber 20, resulting in a net flow of working fluid from the second end 20 of the chamber to the first end 18 of the chamber.

The average temperature of the working fluid 2 is higher during the first phase (compression of working fluid) than during the third phase (expansion of working fluid). More work is therefore done during the first phase, the phase in which work is done on the working fluid, than is done in the third phase, the phase in which the working fluid does work. There is therefore a net input of mechanical work, which forces the net heat flow into the first portion 8 of transfer fluid 6 from working fluid 2, and the net heat flow from second portion 11 of transfer fluid 6 to working fluid 2.

It will readily be understood that during the running of the pump in practice, the four phases of the cycle may elide into one another, with one stage starting before the previous stage has completely finished. It will also be appreciated that although Applicant's preferred embodiment, as described above, includes altering the angle of the moveable wall in relation to the heat exchanger wall and moving the moveable wall towards or away from the heat exchanger wall, embodiments in which at least one moveable wall is flexed to alter the proportions of working fluid at each end of the heat pump are also contemplated. The moveable wall only needs to be at least partially moveable.

Pump 1 has a large distance (as large as practically possible) between first end 10 and second end 13. Pump 1 also has a small gap between heat exchanger wall 4 and movable wall 5, in order that heat transfer will occur quickly between the working and transfer fluids. If the distance between the walls 4 and 5 is very small, and the heat exchanger 4 is very efficient, the working fluid and the transfer fluid can be assumed to be at the same temperature as each other at each point along the length of the heat exchanger. There will be a temperature gradient from the first end to the second end of the chamber. The transfer fluid about to exit through port 9 will be at the same temperature as the first end 21 of the heat exchanger wall which will be at the same temperature as the first end 18 of the working fluid chamber 3, this common temperature being higher than temperature T. The transfer fluid about to exit through port 12 will be at the same temperature as the second end 22 of the heat exchanger wall which will be at the same temperature as the second end 20 of the working fluid chamber 3, this common temperature being lower than temperature T.

A sealing means 23 prevents the working fluid from escaping from the chamber 3 during movement of the wall 5.

If two driving members were used, the user would be able to better control the movement of the moveable plate.

Figure 2:
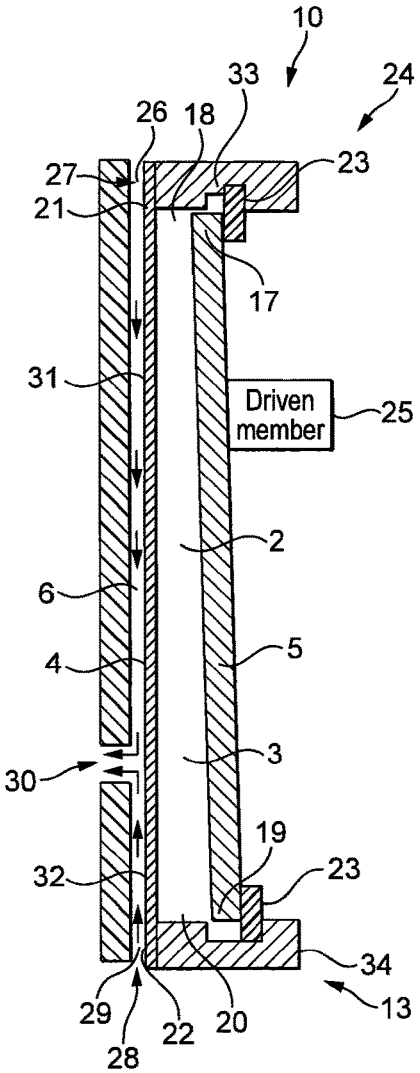
FIG. 2 is a sectional view through a heat engine.

Referring now to FIG. 2, in which like parts to those of FIG. 1 are identified by the same reference numerals, heat engine 24 includes a working fluid 2 within a chamber 3. One wall of the chamber is a heat exchanger 4, and the wall opposed to heat exchanger 4 is a moveable wall 5. Wall 5 is driven by pressure changes in the working fluid 2. Wall 5 drives a driven member 25, which transfers the useful mechanical energy generated by engine 24. Heat exchanger wall 4 is thin, so that there is good heat transfer across the wall, and poor heat transfer down the length of the wall. The sealing means 23 prevents the working fluid from escaping from the chamber 3 during movement of the wall 5.

The heat engine 24 also includes a transfer fluid 6. In engine 24, a first portion of transfer fluid 26 (first heat transfer medium) enters the engine at temperature $T_A$ through a first entry port 27 at the first end 10 of engine 24 and a second portion of transfer fluid 28 (second heat transfer medium) enters the engine at a temperature $T_B$ through a second entry port 29 at the second end 13. These portions merge and exit through a single exit port 30 located at the intermediate portion at a temperature $T_C$, where $T_B<T_C<T_A$. In heat engine 24 the intermediate portion is generally planar, passes through port 30, and is perpendicular to the axis from the first end 10 to the second end 13 of the engine. The heat exchanger wall 4 can be considered to have two sections, a first section 31 in contact with the first portion 26 of the transfer fluid, and a second section 32 in contact with the second portion 28 of the transfer fluid.

The working fluid at the first end 18 of the chamber will receive energy through the heat exchanger wall from the first portion of transfer fluid 26, resulting in the working fluid at the first end 18 of the chamber being at the same temperature as the first end 21 of the heat exchanger wall being the same temperature as the first portion of transfer fluid 26 upon its entry to the engine, this common temperature being $T_A$.

The working fluid at the second end 20 of the chamber will lose energy through the heat exchanger wall to the second portion of transfer fluid 28, resulting in the working fluid at the second end 20 of the chamber being cooled to the same temperature as the second end 22 of the heat exchanger wall, this being the same temperature as the second portion of transfer fluid 28 upon its entry to the engine, this common temperature being $T_B$.

The temperature changes in the working fluid 2 will cause expansion and contraction of the fluid, forcing movable wall 5 to move. The driven member 25 will be driven by the following repeating cycle of movements of movable wall 5:

- A first phase in which movable wall 5 is moved towards heat exchanger wall 4 in a direction perpendicular to wall 4, while the angle between wall 4 and wall 5 is constant.
- A second phase in which the angle between wall 4 and wall 5 is altered, while there is no net movement of wall 5 in relation to wall 4. The angle alteration causes the first end 17 of wall 5 to move away from heat exchanger wall 4, increasing the distance between end 17 and wall 4 at the first end of the chamber 18, while a second end 19 of wall 5 is moved towards heat exchanger wall 4, decreasing the distance between end 19 and wall 4 at a second of the chamber 20, resulting in a net flow of working fluid from the second end 20 of the chamber to the first end 18 of the chamber.
- A third phase in which movable wall 5 is moved away from heat exchanger wall 4 in a direction perpendicular to wall 4, while the angle between wall 4 and wall 5 is constant.
- A fourth phase in which the angle between wall 4 and wall 5 is altered, while there is no net movement of wall 5 in relation to wall 4. The angle alteration causes a first end 17 of wall 5 to move towards heat exchanger wall 4, decreasing the distance between end 17 and wall 4 at the first end of the chamber 18, while a second end 19 of wall 5 is moved away from heat exchanger wall 4, increasing the distance between end 19 and wall 4 at a second of the chamber 20, resulting in a net flow of working fluid from the first end 18 of the chamber to the second end 20 of the chamber.

The average temperature of the working fluid 2 is lower during the first phase (compression of working fluid) than during the third phase (expansion of working fluid). Less work is therefore done during the first phase, the phase in which work is done on the working fluid, than is done in the third phase, the phase in which the working fluid does work. There is therefore a net output of mechanical work, which drives the driven member 25.

Driven member 25 may be shaped to aid this movement cycle. It will readily be understood that during the running of the engine in practice, the four phases of the cycle may elide from one to another, with one stage starting before the previous stage has completely finished.

Engine 24 has a large distance (as long as practically possible) between first end 10 and second end 13. Engine 24 also has a small gap between heat exchanger wall 4 and movable wall 5, in order that heat transfer will occur quickly between the working and transfer fluids. If the distance between the walls 4 and 5 is very small, and the heat exchanger 4 is very efficient, the working fluid and the transfer fluid can be assumed to be at the same temperature as each other at each point along the length of the heat exchanger.

The alternative arrangement engine in which flexure of a moveable wall in an engine is caused by the working fluid is also contemplated. The or each moveable wall only needs to be at least partially moveable.

Figure 3:
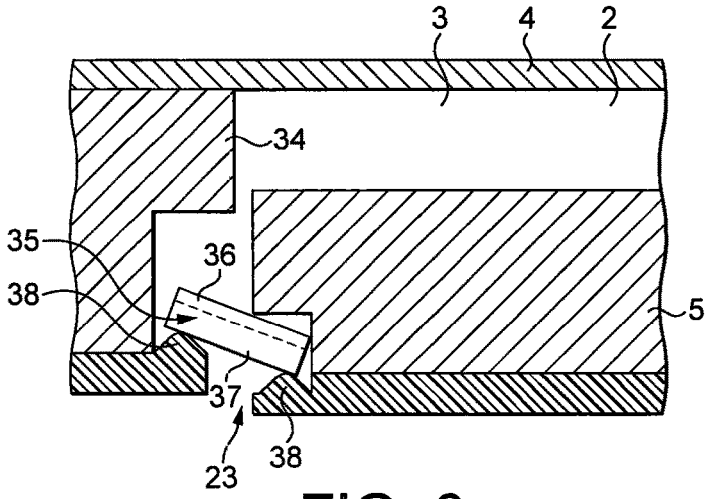
FIG. 3 is a sectional view of a heat pump or a heat engine, showing the seal at one end of the working chamber when the distance between the heat exchanger wall and the movable wall at that end of the chamber is at a maximum.
Figure 4:
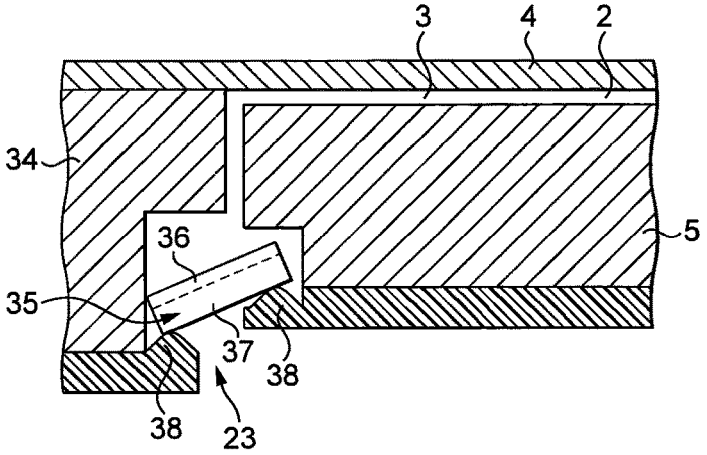
FIG. 4 is a sectional view of a heat pump or a heat engine, showing the seal at one end of the working chamber when the distance between the heat exchanger wall and the movable wall at that end of the chamber is at a minimum.

Referring now to FIG. 3 and FIG. 4, an example of a sealing means for the working chamber of a heat engine or a heat pump is shown. In FIGS. 3 and 4, the working fluid 2 is contained within the working chamber 3. The working chamber 3 is defined by heat exchanger wall 4, movable wall 5, first and second end walls 33 and 34 (wall 33 not depicted in these figures), first and second side walls (not depicted) and sealing means 23.

In the above embodiment, sealing means 23 includes a flexible seal 35 arranged around the border between moveable wall 5 and the fixed end walls 33, 34 and side walls of the chamber. Flexible seal 35 has a pliable or elastic upper section 36 and a metal lower section 37, the thermally conductive metal section being in contact with thermally conductive seal stops 38. Metal lower section 37 may be corrugated to keep the seal rigid between the seal stops but to allow the seal to twist as the movable wall moves. The contact between the thermally conductive seal stops and the thermally conductive metal part of the seal provides for good heat transfer between the seal and the seal stops, which will usually be around ambient temperature. This means that the sealing means will be exposed to the extreme temperatures of the engine to a lesser extent than it would otherwise be. In order to further reduce the exposure of the sealing means to the temperature extremes of the engine or pump, the sealing means is positioned in a recess set slightly apart from the majority of the working fluid. This recess is filled with the working fluid. However, the recess is shaped to keep the ratio of the volumes between the working chamber and the recess as near constant as possible, in order to reduce the flow of fluid between the working chamber and the recess. This, in combination with the thermal conductivity of the seal and seal stops, helps to prevent the seals reaching the temperature extremes of the engine or pump. It will readily be understood that there could still be some flow of working fluid between the main working fluid chamber and the recess. It will also be readily understood that alternative suitable sealing means could be used to prevent the working fluid escaping the chamber, and that variations may be made in the above arrangement.

The embodiments of heat pump and heat engine described above have a working chamber and a heat exchanger wall that have as great a distance as is practically possible between their first and second ends, and they have a small gap between the heat exchanger wall and the wall opposing the heat exchanger wall. Both of these factors increase the rate of heat transfer between the working and transfer fluids. The rate of heat exchange between the transfer and working fluids may be further improved by altering the flow of the working fluid.

Figure 5:
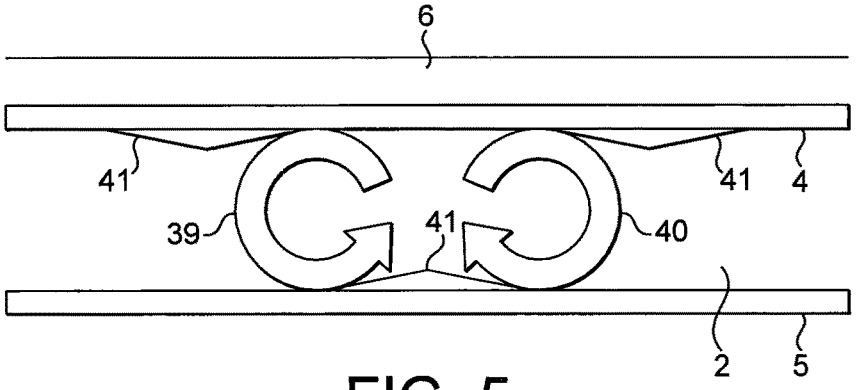
FIG. 5 is a diagram illustrating one way in which the heat exchanger wall and the wall opposed to the heat exchanger wall could be shaped to adjust the flow of the working fluid.

FIG. 5 depicts an embodiment in which heat exchanger wall 4 and movable wall 5 (which is the wall opposing heat exchanger wall 4 in this embodiment) are shaped to cause the working fluid to flow between walls 4 and 5 in a plurality of "rods" 39, 40 of fluid, each "rod" 39, 40 of fluid consisting of fluid following a generally helical path The "rods" of fluid and the helical motion are caused by a plurality of protrusions 41 on wall 4 and wall 5. In the above embodiment, each "rod" of fluid extends from the first end 18 to the second end 20 of the working chamber.

Causing the working fluid to flow in a helical path increases the length of path the fluid travels along while in contact with the heat exchanger wall 4, thereby increasing the effective area for heat transmission. The working fluid will flow faster down the helical path, decreasing the thickness of the boundary layer of the fluid, and increasing the rate of heat exchange. In an ideal implementation of a pump or engine as described above, there would be instantaneous heat transfer across the heat exchanger. This is not possible in practical machines, but the faster and more efficient the heat exchange can be made, the closer to ideal the pump or engine will be. As the operating conditions become closer to ideal, the pump/engine will obtain closer to its theoretical maximum efficiency.

It will readily be understood that providing indentations in the walls in place of or in addition to protrusions could also provide the desired effect on the working fluid. It will also be understood that in place of protrusions and/or indentations on the surface of the walls, the texture of the wall surface may be varied in such a way to cause changes in the speed of the working fluid. It will also be understood that in place of or in addition to texturing the wall(s) or providing a series of discrete protrusions and/or indentations, the walls could be continuously contoured to alter the flow of the working fluid.

It is preferable that there is little or no flow of working fluid 2 along the first end 18 and second end 20 of the working chamber 3, in order to minimize heat transfer between the working fluid and the first and second ends of the working chamber.

It will be clear to the skilled person in the light of the above disclosure that any way of increasing the contact between the working fluid and the heat exchanger or of increasing the speed of the working fluid while flowing over the heat exchanger will increase the rate of heat transfer. Conventional heat exchanger methods may be used between the heat exchanger wall and the transfer fluid, but the working fluid must be freely able to expand and contract, meaning that many prior methods of heat exchange will be unsuitable for the interface between the heat exchanger wall and the working fluid.

Figure 6:
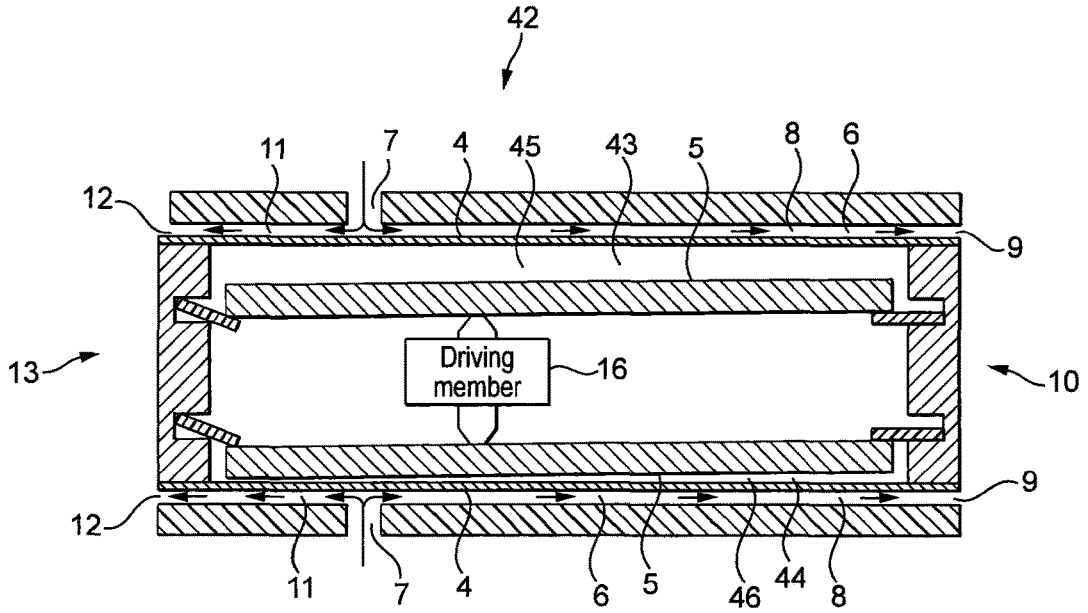
FIG. 6 is a sectional view of two heat pumps combined, arranged together in order that a single driving member (actuator) may drive the movable walls of the working chambers of each pump simultaneously.

FIG. 6 shows a dual heat pump 42, in which two heat pumps as in FIG. 1 are positioned so that their respective movable walls 5 may be driven by the same driving member or driving members (actuator or actuators). Each pump has a heat exchanger wall 4 and a transfer fluid 6. Transfer fluid 6 enters each side of pump 42 through entry ports 7 at temperature T. Transfer fluid 6 splits within each pump, first portions 8 flowing from entry ports 7 to a first exit ports 9 at a first end 10 of pump 42, and a second portion 11 of transfer fluid 6 flowing from entry port 7 to a second exit port 12, located at a second end 13 of pump 42. Pump 42 has two working chambers 43, 44, containing two separate working fluids 45, 46.

Walls 5 remain parallel to each other during their repeating cycle of driven movements. The driven movements of walls 5 in pump 42 are identical to that in pump 1, but in this configuration, working chamber 44 will be two steps behind working chamber 43, i.e while the volume of chamber 43 is being increased, the volume of chamber 44 will be being decreased, and so on.

Walls 5 may be driven by a single driving member that is offset from the centre of the wall so that the sections of the moveable walls furthest from the driving member will lag behind the sections of walls closest to the driving member. Alternatively, the moveable walls of the chamber may be driven by two driving members, optionally with a phase difference between the two driving members.

In dual pump 42 there is a cavity formed between the moveable plates 5. This cavity is driven back and forth by the driving member or driving members. If the cavity were to contain a fluid it would be at a higher pressure at one end of the cavity, and this pressure difference could be exploited to pump fluid though the cavity. The pumped fluid could be used as the transfer fluid in pump 42. This would also serve to maintain the temperature of the sealing means and the driving member or members.

In practice, when a dual heat pump similar to pump 42 is set up, the parallel moveable plates 5 should be relatively close together in order to keep the fluid cavity between the plates small. This will firstly reduce the size of the overall setup, and, more importantly, will help to prevent standing waves being set up in the fluid within the cavity. In order that plates 5 can be positioned close together, a suitable actuator (or actuators) would be necessary. The actuator(s) should preferably have a short stroke and high efficiency and should interact directly with the plates. One embodiment of a suitable actuator is described below with reference to FIGS. 13-17.

Figure 7:
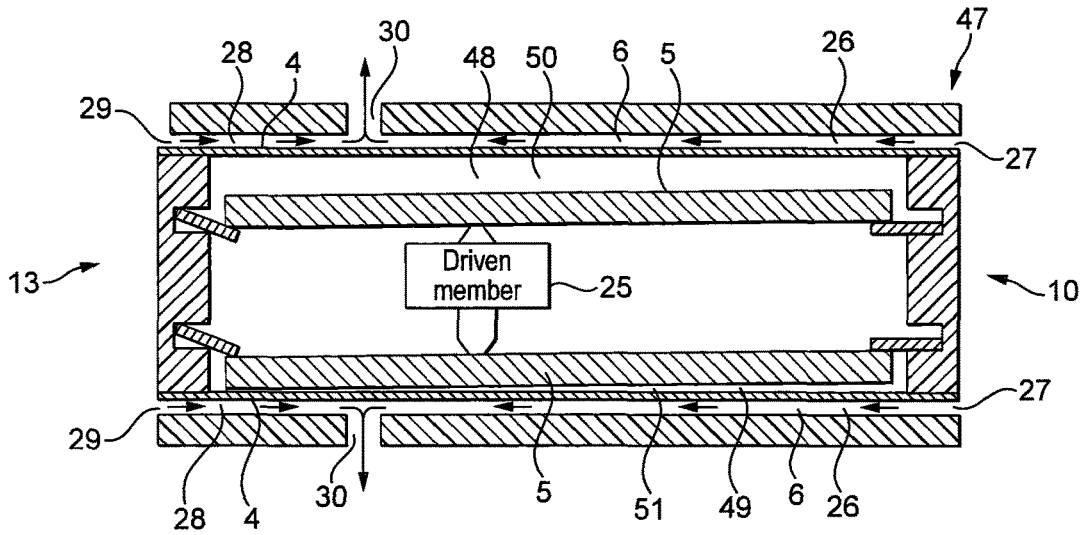
FIG. 7 is a sectional view of two heat engines combined, arranged together in order that a single driven member may be driven by the movable walls of the working chambers of each engine simultaneously.

FIG. 7 shows a dual heat engine 47, in which two heat engines as in FIG. 2 are positioned so that their respective movable walls 5 may drive the same driven member or driven members. Each engine has a heat exchanger wall 4 and a transfer fluid 6.

Engine 47 has two working chambers 48, 49, containing two separate working fluids 50, 51. In engine 47, two first portions of transfer fluid 26 enter the engine at temperature $T_A$ through first entry port 27 at the first end 10 of engine 47 and second portions of transfer fluid 28 enter the engine at a temperature $T_B$ through second entry ports 29 at the second end 13. These portions merge and exit through respective exit ports 30 at a temperature $T_C$, where $T_B<T_C<T_A$. Walls 5 are driven by pressure changes in the working fluids 50, 51. Wall 5 drives a driven member 25, which transfers the useful mechanical energy generated by engine 47.

Walls 5 remain parallel to each other during their repeating movement cycles. The movements of walls 5 in engine 47 are identical to that in engine 24, but in this configuration, working chamber 49 will be two steps behind working chamber 48, i.e while the volume of chamber 48 is increasing, the volume of chamber 49 will be decreasing, and so on.

Walls 5 may drive a single driven member. Alternatively, the moveable walls 5 of the chamber may drive two driven members, optionally with a phase difference between the said driven members.

In dual engine 47 there is a cavity formed between the moveable plates 5. This cavity is driven back and forth by the moveable walls. If the cavity were to contain a fluid it would be at a higher pressure at one end of the cavity, and this pressure difference could be exploited to pump fluid though the cavity. The pumped fluid could be used as the transfer fluid in dual engine 47. This would also serve to maintain the temperature of the sealing means and the driven member or members.

In a further arrangement (not depicted) a pump and an engine could be arranged together such that a driving member of the pump is a driven member of the engine. In this configuration, there would again be a cavity between the respective moveable walls of the pump and the engine. This cavity could be filled with a fluid, and pressure changes in the fluid could be exploited to pump fluid though the cavity. The pumped fluid could be used as the transfer fluid the engine and or the pump. This would also serve to maintain the temperature of the sealing means and the driven/driving member or members.

Figure 8:
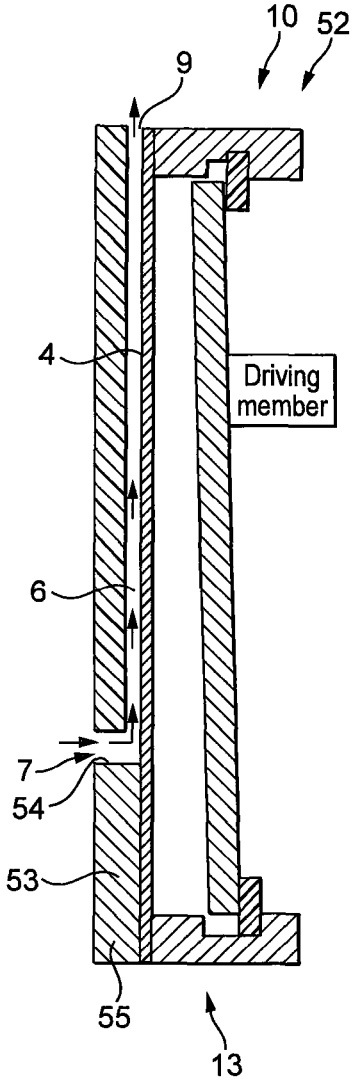
FIG. 8 is a sectional view through an alternative embodiment of a heat pump.
Figure 9:
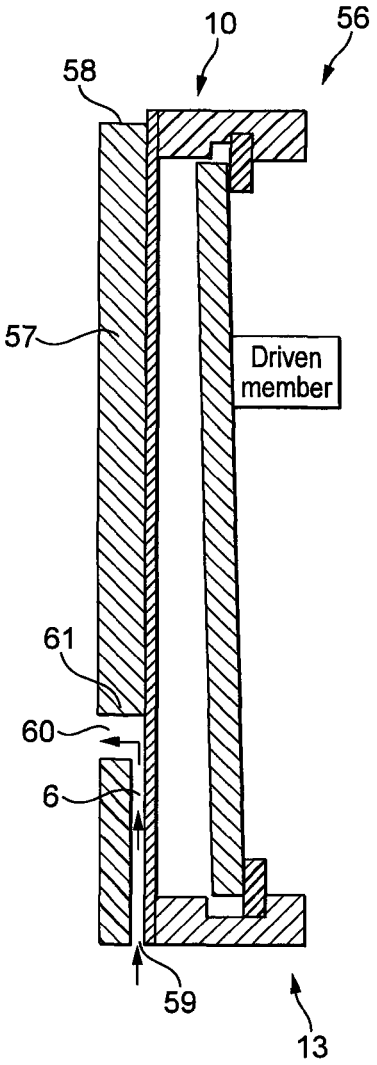
FIG. 9 is a sectional view through an alternative embodiment of a heat engine.

FIGS. 8 and 9 depict alternative embodiments of the above pump and engine, in which only one of the heat exchange mediums includes a fluid.

In the heat pump of FIG. 8, the first heat transfer medium is a transfer fluid 6 that enters the pump 52 through entry port 7 at temperature T. The intermediate portion of pump 52 is generally planar, passes through port 7, and is perpendicular to the axis from the first end 10 to the second end 13 of the pump. Transfer fluid 6 flows past heat exchanger wall 4 and exits the pump through an exit port 9 located at the first end 10 of the pump. The second heat exchange medium 53 is a solid with suitable thermal conductivity. Medium 53 should allow for the required good heat transfer between the medium 53 and the working fluid 2, while maintaining a temperature gradient between the first end and the second end of the medium 53. In operation of the pump, end 54 of the second heat exchange medium will be provided with a temperature approximately equal to T. This heat may be provided by transfer fluid 6 or by any other suitable heat source. During operation of the pump, the second heat exchange medium 53 will lose energy to the working fluid, resulting in the temperature at the second end 55 nearest to the second end 13 of the pump having a temperature lower than temperature T. The pump operates in the same manner as pump 1, and it will readily be understood that any features or preferred embodiments of pump 1 may be incorporated into a pump similar to pump 52 as appropriate.

In the heat engine 56 of FIG. 9 the first heat exchange medium 57 is a solid with suitable thermal conductivity. In operation of the engine, end 58 of the first heat exchange medium will be provided with a temperature $T_A$. The second transfer medium includes a transfer fluid 6 that enters the engine at a temperature $T_B$ through an entry port 59 at the second end 13 of the engine and exits the engine through an exit port 60 at a temperature $T_C$, where $T_B<T_C<T_A$. The intermediate portion is generally planar, passes through port 59, and is perpendicular to the axis from the first end 10 to the second end 13 of the engine. Due to the transfer of heat from the first heat exchanger medium 57 to the working fluid, the end 61 of the medium 57 that is near to the exit port 60 will be at approximately temperature $T_C$. Engine 56 works in the same manner as engine 24 and it will readily be understood that any features or preferred embodiments of engine 24 may be incorporated into an engine similar to engine 56 as appropriate. Medium 57 should allow for the required good heat transfer between the medium 57 and the working fluid 2, while maintaining a temperature gradient between the first end and the second end of the medium 57.

Figure 10:
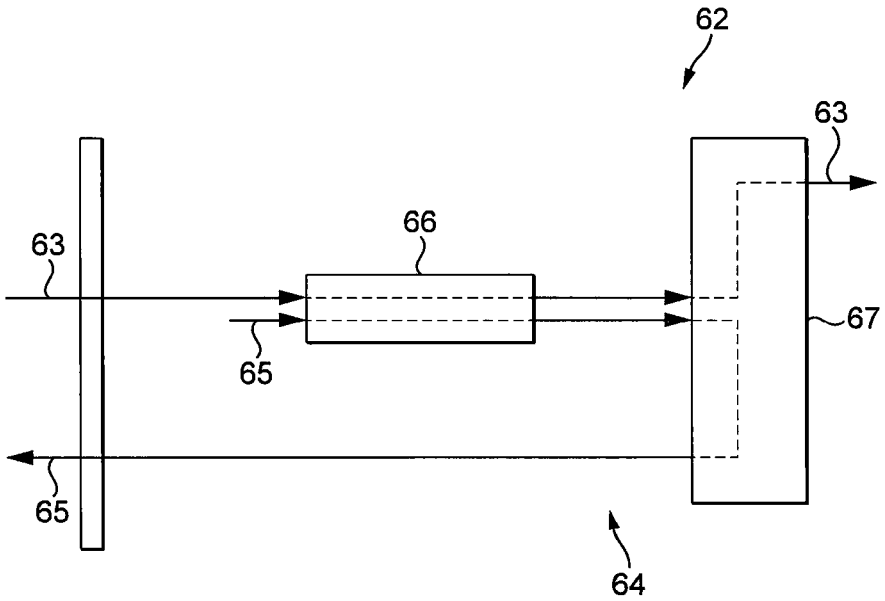
FIG. 10 is diagram for a HVAC system using a heat pump.
Figure 11:
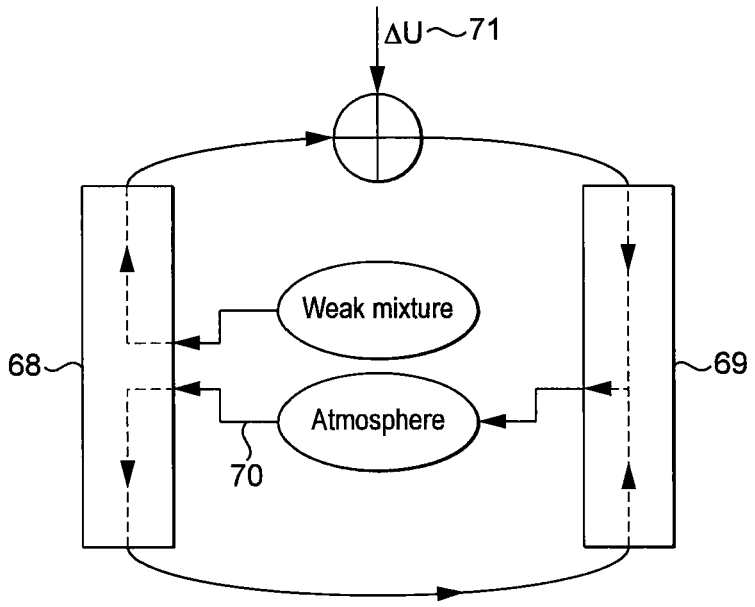
FIG. 11 is a diagram of a system in which a heat pump and a heat engine are connected together in order to oxidise a mixture including a flammable gas.

FIGS. 10 and 11 demonstrate potential uses for the above heat pumps and heat engines.

FIG. 10 is a schematic diagram for an HVAC system 62. External air 63 from outside a room 64 and internal air 65 from within the room 64 pass through a device 66 which may be a conventional heat exchanger or a heat engine as described above, the two streams leave the device at the same temperature as each other. Streams 63 and 65 pass into a heat pump 67, which may be any heat pump described above. External air stream 63 is heated by pump 67 and heated airstream 63 enters the room. Internal airstream 65 is cooled by pump 67 and is ejected from the room. It will be readily understood that a pump as above could alternatively be configured to provide cooling to the room, instead of heating.

FIG. 11 shows a system in which a heat pump 68 and a heat engine 69 are connected together. Pump 68 and engine 69 may be any of the pumps/engines described above. In this configuration, atmospheric temperature transfer fluid 70 enters pump 68 and is cooled by the pump, the cooled fluid exiting pump 68 and then entering engine 69 at its "cold" second end. A flammable gas at a low concentration at atmospheric temperature enters pump 68 at the central entry port, and is heated by the pump. The system is set up so that the increase in the temperature of the mixture of flammable gas is great enough that the gas can be oxidized at a point 71 after leaving the hot end of the heat pump, the oxidation of the mixture providing heat energy between the hot exit port of the pump and the hot entry port of the engine.

It will readily be understood that in embodiments where any pump and any engine are connected in a similar manner to above, the external energy source required between the "hot" end of a pump (the first end as described above) and the "hot" end of an engine (the first end as described above) may take the form of solar power, geo-thermal power, power from combustible material, or any other suitable external energy source.

Figure 12:
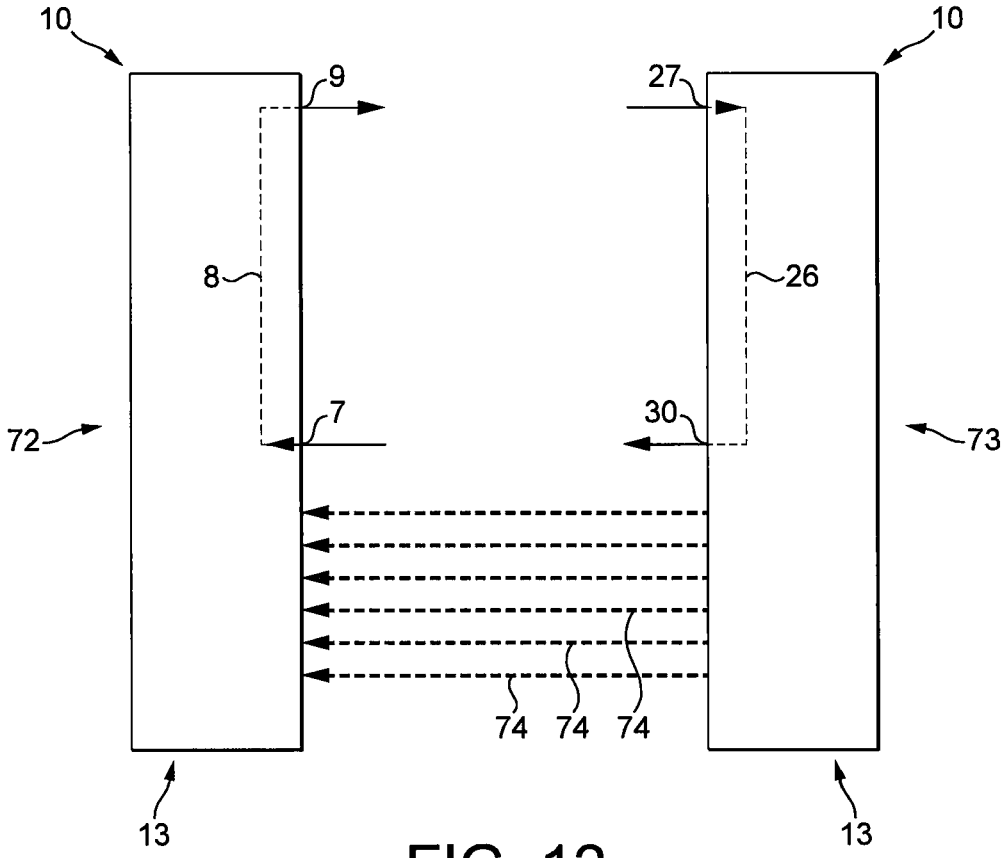
FIG. 12 is a diagram of a system in which a heat pump and a heat engine are connected together so that part of the working fluid for each is a heat transfer medium for the other.

FIG. 12 shows a further alternative way that a pump and an engine substantially as described above may be connected together, with an intermediate portion that is generally planar, and passes through ports 7 and port 30. This arrangement is suitable when the two heat exchanger mediums have the same temperature range and the same rate of heat transfer as each other between the intermediate portion and the second end of the apparatus.

In this embodiment, the portions of the heat exchanger walls of the pump and the engine between the intermediate portion and the second end of the apparatus are thermally connected via a series of heat transfer paths 74. Each heat transfer path should enable good heat transfer between the two working fluids, but poor heat transfer in the direction parallel to the axis from the first 10 to the second 13 end of the apparatus. This could be achieved by providing channels with an inner core comprising a good thermal conductor, and an outer casing comprising a good thermal insulator. In this embodiment, the heat exchanger paths would be the heat exchanger medium for each working fluid between the intermediate portion and the second end of the apparatus. Thus, in operation of the pump and engine system, there is a transfer of heat energy from the working fluid of the engine between its intermediate portion and its second end via its heat exchanger wall to heat transfer paths 74, and from heat transfer paths 74 to the working fluid of the pump between its intermediate portion and its second end via its heat exchanger wall.

It will readily be understood that in practical implementations of the embodiment described in FIG. 12, the distance between the working chambers of the pump and engine would be kept as small as practicable, in order to keep the length of heat transfer paths 74 as short as possible.

In a similar embodiment (not depicted), a pump and an engine are arranged so that the second heat transfer medium of the pump is the working fluid of the engine between the intermediate portion and its second end, and so that the second heat transfer medium for the engine is the working fluid of the pump between the intermediate portion and its second end. This could be achieved by configuring the pump and engine so that their second ends are adjacent to each other, and forming the sections of the heat exchanger walls between the intermediate portion and the second end of the apparatus from a series of heat transfer paths, as described above, between the respective working fluids. In this embodiment, heat energy would transfer from one working fluid to the other via the heat transfer paths only.

It will also be readily understood that variants of the above systems could be produced where the working fluids between the respective first ends and intermediate portions are thermally connected by such heat transfer paths, and it should be noted that the thermal connection between the working fluids via heat transfer paths may be done through the moving wall or via the wall opposed to the moving wall.

Figure 13:
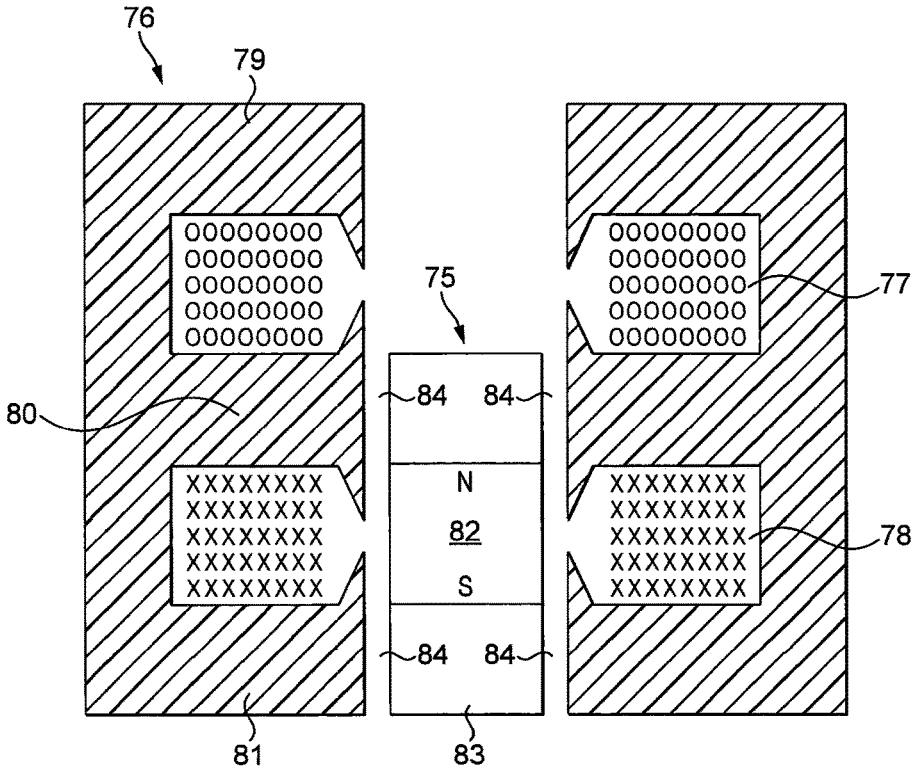
FIG. 13 is a sectional view of an embodiment of an actuator (driving member) for use in any of the above pumps, with a moving stator in a first position.
Figure 14:
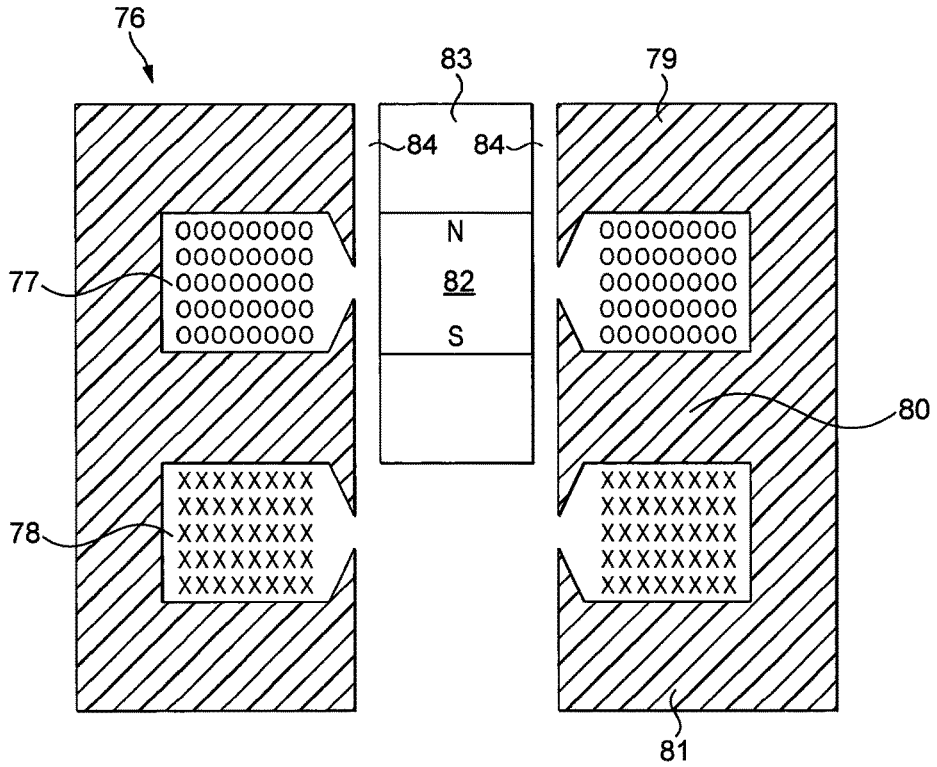
FIG. 14 is a sectional view of the actuator (driving member) of FIG. 13, with the moving stator in a second position.

FIGS. 13 and 14 each show a cross section of part of a suitable actuator (driving member) for use in any of the above pumps. It appears to Applicant that the actuator suggested is novel and inventive in its own right, in addition to being a component of heat pumps as discussed above.

An actuator comprises an armature and a stator that is movable relative to the armature, at least one of the stator and the armature being formed from a ferromagnetic material; the stator at least partially surrounding two annular conductors, the annular conductors sharing an axis and being arranged, in use, to have current flowing through them such that the current flowing through one annular conductor flows in a different direction to the current in the other annular conductor; in order that changing the currents in the conductors alters the flux experienced by the armature, causing movement of the armature relative to the stator.

The actuator may have one or more of the following features; the armature comprises a permanent magnet. The armature comprises magnetic pole pieces. The armature comprises air gaps. The stator has limbs passing around and/or between the conductors. The stator has three limbs, the first limb being located above the first conductor, the second limb being located between the first and second conductor, and the third limb being located beneath the second conductor ("above" and "below" being relative terms referring to the actuator when viewed from one angle; but it should be noted that the actuator could be rotated and used in other orientations).

The actuator includes an armature 75 and a stator 76 that is movable relative to the armature. Stator 76 is formed from soft iron (although it will be appreciated that any soft ferromagnetic material would be suitable), and stator 76 partially surrounds an upper annular conductor 77 and a lower annular conductor 78, conductors 77 and 78 being electromagnets in this embodiment, and being provided in use with an electrical current (power source not depicted). The stator has an upper limb 79, a middle limb 80 and a lower limb 81. The direction of current in the conductors 77, 78 is shown using the convention that current flow into the paper is represented by an X and current flow out of the paper is represented by an O. The armature 75 comprises a permanent magnet 82, soft magnetic pole pieces 83 and air gaps 84.

In FIG. 13, the stator 76 and the conductors 77, 78 are shown in a first position relative to the armature 75, which is stationary in this embodiment. With the stator in this position, the flux from permanent magnet 82 will mostly flow through the middle limb 80, around the lower annular conductor 78 and return through the lower limb 81. In FIG. 14, the stator 76 and the conductors 77, 78 are shown in a second position relative to the armature 75. With the stator in this position, the flux from permanent magnet 82 will mostly flow through the upper limb 79, around the upper annular conductor 77 and return through the middle limb 80. The respective currents passing through the annular conductors 77 and 78 will interact with the magnetic field of the armature, and consequently a force will be caused, moving the stator and annular conductors between their first and their second position.

Figure 15:
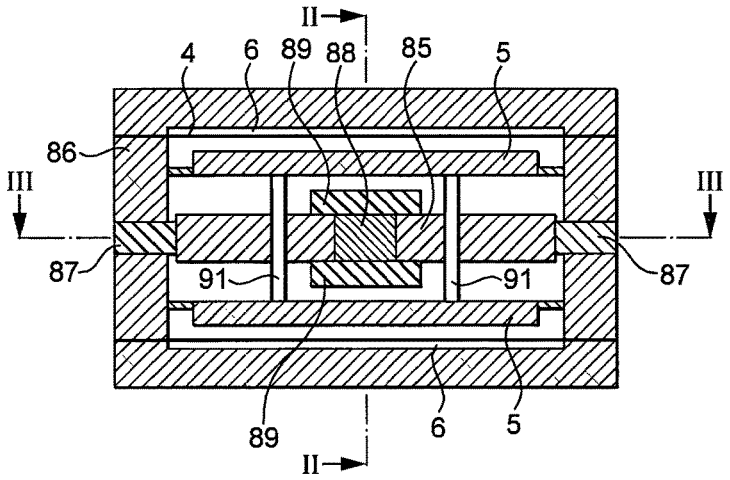
FIG. 15 is a sectional view along line I-I of FIG. 17, showing an actuator and a torsion bar.
Figure 16:
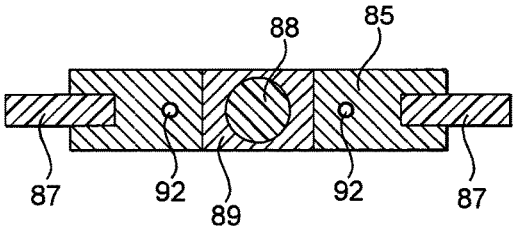
FIG. 16 is a sectional view along line of FIG. 15 (movable walls, heat exchanger wall, entry ports, exit ports and transfer fluid all omitted for clarity)
Figure 17:
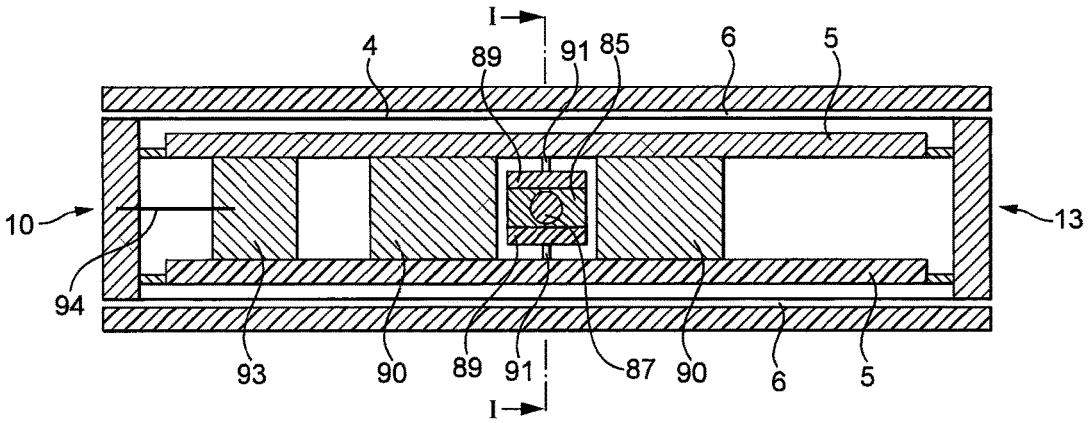
FIG. 17 is a sectional view along line II-II of FIG. 15.

FIG. 15-17 show an actuator for use in a dual heat pump as in FIG. 6. Like reference numerals are used for like features. In FIGS. 15-17, the driving member (actuator) comprises an armature 85 that is connected to an outer wall 86 of the heat pump by torsion bars 87 (the torsion bars serving as biasing means that restrain the lag of the heavier end of the movable wall, energy stored in the torsion bars being used to move the working fluid). Armature 85 comprises a permanent magnet 88 and pole pieces 89. (Moving) stators 90 and guide poles 91 are affixed to moveable walls 5. Guide poles 91 pass through guide holes 92 in armature 85, and the guide poles are free to slide through the holes 92 as the moveable walls and the stators move.

As explained in relation to FIG. 6, the moveable walls will remain parallel to each other during their repeating cycle of driven movements (in this embodiment aided by guide poles 91 and guide holes 92). In FIGS. 15-17 the moveable walls are made heavier at one end than at the other end in order that the heavier end of the moveable wall will lag behind the lighter end of the movable wall, by the addition of a weight 93. There is a second biasing means, a spring 94, to restrain the lag of the heavier end of the movable wall, and energy stored in the spring is used to move the working fluid. Only one biasing means is required. Torsion bars 87 or spring 94 of FIGS. 15-17 could be used independently as the sole biasing means, as could any other suitable biasing means.

It will be readily understood that although the above actuator is described as used in the dual heat pump, the actuator could readily be used as the actuator/driving member for any described heat pump where it would be appropriate. The guide poles and guide holes, or other suitable guide means, could also be used in any of the above discussed pumps or engines or combinations thereof.

An additional heat source or heat sink may be applied to any of the above discussed heat exchangers as appropriate. This can take any suitable form, for example, radiant heat may be supplied to the heat exchanger, and/or a flammable substance may be introduced. If cooling of the heat exchanger is required, a liquid may be introduced to the heat exchanger by any suitable means, including but not limited to a spray or a wick, evaporation of the liquid being capable of cooling the heat exchanger.

The invention claimed is:

1. A heat pump, the heat pump having a first end and a second end and further comprising: a working fluid and a chamber to contain said working fluid, the chamber having a first end and a second end corresponding to the first and second ends of the pump, one wall of the chamber acting as a heat exchanger between the chamber and a first heat transfer medium and one wall of the chamber, which may or may not be the same wall as the first mentioned one wall, acting as a heat exchanger between the chamber and a second heat transfer medium, the first heat transfer medium being located at a position between the first end of the pump and an intermediate portion defined at a position between the first and second ends of the heat pump, the first heat transfer medium operationally having temperature T at the end nearest the intermediate portion, and operationally having a temperature higher than temperature T at the end located nearest the first end of the pump, the second heat transfer medium being located at a position between the intermediate portion and the second end of the pump, and having a temperature T' at the end nearest the intermediate portion in operation of the heat pump, and a temperature lower than T' at the end nearest the second end of the pump in operation of the heat pump, the second heat transfer medium operationally having a lower average temperature than the first heat transfer medium; the chamber having at least one moveable wall, one said moveable wall being driven by an external energy source and being configured to adjust the volume of the chamber, and one said moveable wall, which may or may not be the same wall as the first mentioned one said movable wall, being arranged to be driven by an external energy source and being capable of adjusting the shape of the chamber while keeping the volume of the chamber constant; the driven movements of the at least one moveable wall being capable of producing a repeating cycle including the following phases:

a first phase in which the volume of the chamber is decreased;

a second phase in which the shape of the chamber can be altered without a change in chamber volume so that a greater volume of the working fluid is at the second end of the chamber than is at the first end of the chamber;

a third phase in which the volume of the chamber is increased; and a fourth phase in which the shape of the chamber can be altered without a change in chamber volume so that a greater volume of the working fluid is at the first end of the chamber than is at the second end of the chamber;

this cycle causing a net flow of heat into the first heat transfer medium from the working fluid, and causing a net flow of heat from the second heat transfer medium into the working fluid.

2. A heat pump according to claim 1, wherein the first heat transfer medium comprises a transfer fluid and a channel to contain said transfer fluid, wherein the transfer fluid operationally enters the channel at a temperature T through an entry port, the entry port being located at or near the intermediate portion, and wherein the transfer fluid operationally exits the channel at a temperature higher than temperature T through an exit port, the exit port being located at or near the first end of the pump.

3. A heat pump according to claim 1, wherein the second heat transfer medium comprises a transfer fluid and a channel to contain said transfer fluid, wherein the transfer fluid operationally enters the channel through an entry port at a temperature T' in operation of the heat pump, the entry port being located at or near the intermediate portion, and wherein the transfer fluid operationally exits the channel through an exit port in operation of the heat pump, the exit port being located at or near the second end of the pump.

4. A heat pump according to claim 1, wherein there is only one moveable chamber wall, the movement of that wall causing both the volume changes in the chamber and the shape changes in the chamber.

5. A heat pump according to claim 1, wherein the wall acting as a heat exchanger, and/or the wall opposed to the wall acting as a heat exchanger, is shaped or textured to alter the flow of the working fluid through the chamber; preferably, the texturing or shaping of the wall acting as a heat exchanger, and/or the texturing or shaping of the wall opposed to the wall acting as a heat exchanger causes the working fluid to flow in a helical path from one end of the chamber to the other end of the chamber, more preferably in a plurality of helical rods from one end of the chamber to the other end of the chamber.

6. A heat pump according to claim 5, wherein the texturing or shaping of the wall acting as a heat exchanger, and/or the texturing or shaping of the wall opposed to the wall acting as a heat exchanger, causes the direction of rotation of each fluid rod to be opposite to the direction of neighboring fluid rods.

7. A heat pump according to claim 1, the pump further comprising a sealing means for the periphery of the or each moveable wall of the chamber, wherein the sealing means preferably comprises a band of pliable material, and preferably comprises a band of thermally conductive material, more preferably metal, most preferably corrugated metal.

8. A heat pump according to claim 7, wherein the sealing means for the or each moveable wall of the chamber includes seal-stops, the seal stops preferably being thermally conductive, and wherein the sealing means for the or each moveable wall of the chamber includes a corrugated metal section and a pliable or elastic section, the metal section of the seal being in contact with the seal-stops.

9. A heat pump according to claim 7, wherein the sealing means is positioned in a recess filled with the working fluid, the recess being set apart from the majority of the working fluid, the recess preferably being shaped to keep the ratio between the working chamber and the recess as near constant as possible, in order to reduce the flow of fluid between the working chamber and the recess.

10. A heat engine, the heat engine having a first end and a second end and further comprising: a working fluid and a chamber to contain said working fluid, the chamber having a first end and a second end corresponding to the first and second ends of the engine, one wall of the chamber acting as a heat exchanger between the chamber and a first heat transfer medium and one wall of the chamber, which may or may not be the same as the first mentioned one wall, acting as a heat exchanger between the chamber and a second heat transfer medium, the first heat transfer medium being located at a position between the first end of the engine and an intermediate portion defined at a position located between the first and second ends of the heat engine, the first heat transfer medium having a temperature $T_A$ at the end nearest the first end of the engine in operation of the heat engine, and a temperature lower than $T_A$ at the end nearest the intermediate portion in operation of the heat engine, the second heat transfer medium being located at a position between the intermediate portion and the second end of the engine, and having a temperature $T_B$ at the end nearest the second end of the engine in operation of the heat engine, and a temperature higher than $T_B$ at the end nearest the intermediate portion in operation of the heat engine, $T_B$ being colder than $T_A$, and the second heat transfer medium operationally having a lower average temperature than the first heat transfer medium; the chamber having at least one moveable wall, one said moveable wall being configured to allow changes in the volume of the chamber, and one said moveable wall, which may or may not be the same wall as the first one said movable wall, being configured to allow adjustment of the shape of the chamber while keeping the volume of the chamber constant; the heat engine being configured to allow a net flow of heat energy from the first heat transfer medium into the working fluid and a net flow of heat energy from the working fluid into the second heat transfer medium to cause variations in the pressure of the working fluid of the chamber, forcing the at least one movable wall to move in a repeating cycle including the following phases:

- a first phase in which the volume of the chamber is decreased;
- a second phase in which the shape of the chamber can be altered without a change in chamber volume so that a greater volume of the working fluid is at the first end of the chamber than is at the second end of the chamber;
- a third phase in which the volume of the chamber is increased; and
- a fourth phase in which the shape of the chamber can be altered without a change in chamber volume so that a greater volume of the working fluid is at the second end of the chamber than is at the first end of the chamber;

the movement cycle being a usable source of mechanical motion during operation of the engine.

11. A heat engine according to claim 10, wherein the first heat transfer medium comprises a transfer fluid and a channel to contain said transfer fluid, the transfer fluid entering the channel through an entry port at a temperature $T_A$ in operation of the heat engine, the entry port being located at or near the first end of the engine, and the transfer fluid operationally exiting the channel at a temperature lower than temperature $T_A$ through an exit port, the exit port being located at or near the intermediate portion.

12. A heat engine according to claim 10, wherein the second heat transfer medium comprises a transfer fluid and a channel to contain said transfer fluid, the transfer fluid operationally entering the channel at a temperature $T_B$ through an entry port, the entry port being located at or near the second end of the engine, and the transfer fluid operationally exiting the channel at a temperature higher than temperature $T_B$ through an exit port, the exit port being located at or near the intermediate portion.

13. A heat engine according to claim 10, wherein there is only one moveable chamber wall, the movement of that wall being caused by the changes in pressure in the working fluid and resulting in both the volume changes in the chamber and the shape changes in the chamber.

14. A heat engine according to claim 10, wherein the wall acting as a heat exchanger, and/or the wall opposed to the wall acting as a heat exchanger, is shaped or textured to alter the flow of the working fluid through the chamber; preferably, the texturing or shaping of the wall acting as a heat exchanger, and/or the texturing or shaping of the wall opposed to the wall acting as a heat exchanger causes the working fluid to flow in a helical path from one end of the chamber to the other end of the chamber, more preferably in a plurality of helical rods from one end of the chamber to the other end of the chamber.

15. A heat engine according to claim 14, wherein the texturing or shaping of the wall acting as a heat exchanger, and/or the texturing or shaping of the wall opposed to the wall acting as a heat exchanger, causes the direction of rotation of each fluid rod to be opposite to the direction of neighboring fluid rods.

16. A heat engine according to claim 10, the engine further comprising a sealing means for the periphery of the or each moveable wall of the chamber, wherein the sealing means preferably comprises a band of pliable material, and preferably comprises a band of thermally conductive material, more preferably metal, most preferably corrugated metal.

17. A heat engine according to claim 16, wherein the sealing means for the or each moveable wall of the chamber includes seal-stops, the seal stops preferably being thermally conductive, and wherein the sealing means for the or each moveable wall of the chamber includes a corrugated metal section and a pliable or elastic section, the metal section of the seal being in contact with the seal-stops.

18. A heat engine according to claim 16, wherein the sealing means is positioned in a recess filled with the working fluid, the recess being set apart from the majority of the working fluid, the recess preferably being shaped to keep the ratio between the working chamber and the recess as near constant as possible, in order to reduce the flow of fluid between the working chamber and the recess.

19. A pump according to claim 1 in combination with a heat engine to define a pump/engine system, the pump and heat engine being connected in such a way that oxidation of a mixture of flammable gas provides a source of energy that is used in the running of the pump/engine system.

20. A method for pumping heat to a first heat transfer medium from a second heat transfer medium that has a lower average temperature than the first heat transfer medium, the method comprising the steps of:

(a) providing a heat pump having a working fluid and a chamber to contain said working fluid, the pump having a first end and a second end, and the chamber having a first end and a second end corresponding to the first and second ends of the pump; one of the walls of the chamber serving as a heat exchanger both between the chamber and the first heat transfer medium and between the chamber and the second heat transfer medium;

(b) driving at least one wall of the chamber, which is moveable, with an external energy source in a repeating cycle including the following phases:

a first phase in which the volume of the chamber is decreased;

a second phase in which the shape of the chamber is altered without a change in chamber volume so that a greater volume of the working fluid is at the second end of the chamber than is at the first end of the chamber;

a third phase in which the volume of the chamber is increased; and a fourth phase in which the shape of the chamber is altered without a change in chamber volume so that a greater volume of the working fluid is at the first end of the chamber than is at the second end of the chamber;

to cause a net flow of heat into the first heat transfer medium from the working fluid, and a net flow of heat from the second heat transfer medium into the working fluid.

* * * * *